US005651498A

United States Patent [19]

Meyer et al.

[11] Patent Number: 5,651,498

[45] Date of Patent: Jul. 29, 1997

[54] HEATING SYSTEM WITH HUMIDITY CONTROL FOR AVOIDING WATER CONDENSATION ON INTERIOR WINDOW SURFACES

[75] Inventors: Jeffrey R. Meyer, Minneapolis; T. Michael Tinsley, Coon Rapids, both of Minn.

[73] Assignee: Honeywell Inc., Minneapolis, Minn.

[21] Appl. No.: 505,571

[22] Filed: Jul. 21, 1995

[51] Int. Cl.[6] ..... B01F 3/02

[52] U.S. Cl. ..... 236/44 C; 165/223; 236/91 C; 374/28

[58] Field of Search ..... 236/44 C, 44 A, 236/91 C; 165/20, 21, 223; 374/28

[56] References Cited

U.S. PATENT DOCUMENTS

| | | | |
|---|---|---|---|
| 3,279,699 | 10/1966 | Nelson | 236/44 R |
| 4,896,589 | 1/1990 | Takahashi | 236/44 A X |
| 5,351,855 | 10/1994 | Nelson et al. | 236/44 C |
| 5,516,041 | 5/1996 | Davis, Jr. | 236/91 C X |

*Primary Examiner*—William E. Wayner
*Attorney, Agent, or Firm*—Edward L. Schwarz

[57] ABSTRACT

A space heating system with a controllable air humidification capability calculates a theoretical value for the temperature of the interior surface of the space's windows. The system controls humidity in the space to a level just below that at which water will condense on the window surfaces.

8 Claims, 2 Drawing Sheets

HEATING SYSTEM WITH HUMIDITY CONTROL FOR AVOIDING WATER CONDENSATION ON INTERIOR WINDOW SURFACES

BACKGROUND OF THE INVENTION

In the past, most heating control systems for occupied spaces such as residential dwellings have provided temperature-based control. The comfort they provide has for the most part been adequate. The majority of such systems have an air recirculating system to heat the recirculated air if the space temperature as sensed by a thermostat is below a comfort range and cool the recirculating air if above the comfort range. Humidity control has resulted either from the inherent reduction of humidity which air conditioning units provide, or from water vapor which is added either incidentally or intentionally to the air in or entering the space. It is generally accepted that people within the enclosed space will find relative humidity between approximately 30% and 50% to be comfortable.

In cold weather, even though its relative humidity is very high, outside air has relatively low dew point temperature. The relative humidity of low dew point air decreases when it is heated. If there is significant infiltration of heated outside air into the occupied space during cold weather, the relative humidity of the space may fall to even below 15% if humidity is not added to the space. If humidity becomes too low in an occupied space, there is even the potential for harm as well as discomfort. For example, too low humidity may cause nosebleeds or cracked and bleeding skin which at the very least is uncomfortable. Glued furniture joints may weaken because of too low humidity. Musical instruments such as pianos, harpsichords, guitars, violins, etc. may be damaged or their tuning affected by low humidity. Certain house plants do not thrive if the humidity is consistently below a preferred range. Oil paintings frequently need a minimum humidity to avoid damage to the painted surface.

There are in occupied spaces, sources of water which incidentally increase the humidity of the space. Plants, showers, saunas, cooking, respirating humans and animals, all increase humidity in the occupied spaces. In very cold seasons, these sources are frequently not adequate to raise the humidity sufficiently. Because of this, a frequent practice is to add humidity to the air in occupied spaces either with portable humidifiers or with installed humidification units operating in connection with the heating plant. In many situations, this is adequate to hold the humidification within the closed space to at least close to the desired range. In many situations, relative humidity need not be controlled as accurately as temperature in order to achieve comfort and to avoid harm to people and objects.

There are certain conditions however, where closer control of relative humidity in a space turns out to be important. The condition which we address in our invention here concerns the situation where there are windows exposed to cold outside air. If the interior space dew point temperature (which increases with increasing relative humidity) rises to a temperature above the interior window surface temperature, there will be condensation on the window surface. If interior humidity is grossly excessive in these situations, the condensation may be so great that condensed water will run down the window surface and damage a wood or steel frame in which the window is set. If the outdoor temperature is below freezing and the insulation provided by the window sash is inadequate, frost will form and may even build up to an appreciable thickness over a period of time.

There are even cases where solid ice builds up to a thickness so great on the interior glass pane that it breaks. At the very least, condensation will make it difficult to see out of the window. And condensed water running down the window will often cause streaks making it look dirty. Accordingly, we have found it desirable to limit humidity in occupied spaces during cold weather to prevent this condensation.

There are already control systems for apparatus which can measure and control humidity within a heated space. In U.S. Pat. No. 5,351,855 (owned by the assignee of this application) the outdoor temperature is estimated and from that estimation an acceptable humidity level is determined. This level is used to control the setting of a humidistat which controls the operation of a unit for humidifying air in the enclosed space.

Apparatus for controlling both temperature and humidity within an enclosed space requiring addition of heat and humidity to maintain comfort, to preselected temperature and humidity set points respectively, typically includes a plenum where air circulated to and from the enclosed space can be treated. A return air duct is connected to provide air from the space to the plenum. A heated air duct is connected to allow air flow from the plenum to the space. A fan within the plenum extracts air from the space through the return air duct and forces the extracted air through the conditioned air duct into the space. A heating unit operates responsive to a first value of a heating active signal to heat air flowing through the plenum and ceases operating responsive to a second value of the heating active signal. The heating unit has a heat exchanger within the plenum. An air humidification unit operates responsive to a first value of a humidification active signal to humidify air flowing through the plenum and ceases operates responsive to a second value of the humidification active signal. An indoor temperature sensor within the space supplies an indoor temperature signal encoding a value indicative of the internal temperature of the space. A humidity sensor within the space provides a humidity signal encoding a value indicative of the relative humidity for the air within the space. An outdoor temperature sensor provides an outdoor temperature signal encoding a value indicative of the outdoor air temperature. A humidity set point generator provides a humidity set point signal encoding a humidity set point value.

BRIEF DESCRIPTION OF THE INVENTION

We have found that humidity in an enclosed space during cold weather can be controlled with quite a high degree of accuracy by a system as that just described. By using a closed loop control system for humidity level, the problem of window condensation can be avoided and humidity still held as close as possible to the preferred 30–50% relative humidity range. In our humidity control process, we determine dew point temperature of the air in the space, make an estimate of the temperature of the interior window surface based on the outside air temperature, and adjust humidity to maintain dew point of the space to just below the estimated window surface temperature.

A controller implementing such a system comprises a window temperature calculator receiving the outdoor temperature signal and the indoor temperature signal, and providing a window temperature signal encoding a window temperature value functionally depending on the temperatures encoded in the outdoor temperature signal and the indoor temperature signal. A dew point temperature calculator receives the indoor temperature signal and the humidity signal and provides a dew point temperature signal encoding a dew point temperature value for the space. The dew point temperature value functionally depends on the temperature encoded in the indoor temperature signal and on the value encoded in the humidity signal. Lastly, a humidification unit controller receives the window temperature signal from the window temperature calculator and the dew point temperature signal from the dew point temperature calculator, and responsive to the window temperature exceeding the dew point temperature, provides a humidification active signal having the first value to the air humidification unit.

DESCRIPTION OF THE PREFERRED EMBODIMENT

Figure 1:
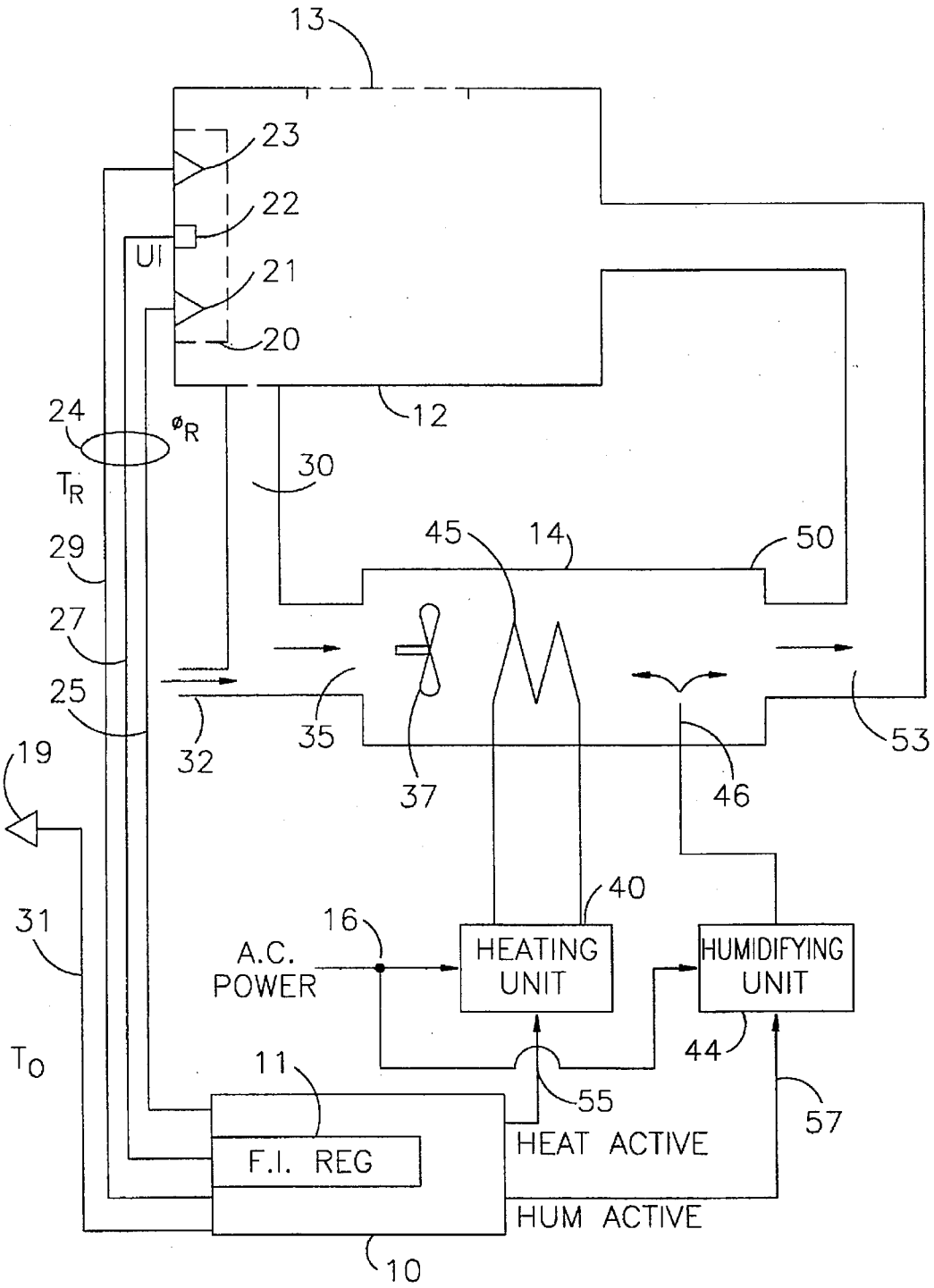
FIG. 1 is a block diagram, including the controller, of apparatus for controlling temperature and relative humidity in an enclosed space.

FIG. 1 shows a typical installation in which the subject invention is incorporated. The installation is designed to maintain selectable temperature and humidity levels within a space 12, typically an area occupied by humans although space 12 could as easily be occupied by livestock or by equipment requiring specialized temperature and humidity levels. At least one window 13 is presumed to be present to justify use of the invention, although the invention can certainly be employed in a windowless space. Conventional parts of this installation include a heating unit 40 and a humidifying unit 44 each requiring an AC power source 16 for proper functioning. Heating unit 40 will typically be a conventional forced air furnace burning gas or oil for heat. A duct or pipe allows a fluid heated by the heating unit 40 to flow to a first heat exchanger 45 mounted within a plenum 14. Heating unit 40 operates to provide heat to heat exchanger 45 responsive to the first value of a heating active signal provided on path 55.

Plenum 14 is connected to receive through duct 30, return air from space 12 as indicated by the arrow. The return air in duct 30 may be mixed with a fraction of fresh air supplied by duct 32. Air which has been heated or cooled within plenum 14 is supplied to space 12 through a supply duct 53 as indicated by the arrow therein. A fan 37 usually positioned at the inlet to of plenum 14 creates a pressure drop which causes the flow of air out of space 14 and through duct 30 to plenum 12 and past heat exchanger 45 to duct 53.

Humidifying unit 44 typically comprises a source of pressurized water and a valve controlling its flow to a nozzle 46 mounted within plenum 14 downstream from heat exchanger 45. Humidifying unit 44 provides a flow of water to its nozzle 46 responsive to the first value of a humidification active signal provided on path 57. Humidifying unit 44 and nozzle 46 are designed to spray a mist of water into air flowing through plenum 14 whenever the humidification active signal has its first value, to thereby increase the relative humidity of the air entering room 12 through duct 53.

A user interface module 20 is mounted on a wall of space 12. Module 20 is shown in FIG. 1 for easier understanding as connected to a controller 10 by multiple paths 25, 27, 29 and 31, each dedicated to carrying a single specific signal. In the preferred commercial embodiment there are many more signals than three which are exchanged by module 20 and controller 10. It is easy to implement the exchange of this multiplicity of signals with a single bidirectional serial communication path 24 symbolized by the dotted line ring. With such a serial path 24, individual signals may be transmitted either during assigned time slices or with individual identifier codes, either of which methods allow the receiving device to determine the type of parameter encoded in the signal.

Encoding and identifying the various signals exchanged by the module 20 and the controller 10 is only one set of functions which module 20 and controller 10 perform. There are also the many control functions involved with properly operating the heating and cooling units and the fan, and allowing the user to communicate with controller 10. While dedicated hardware is one structure possible for this system, more normally module 20 and controller 10 will each comprise a microprocessor programmed to perform or control the various functions required for the device, including communication functions with the other device.

It is convenient to implement the communication functions here between the microprocessors with a commercially available chip set based on one of the serial communication protocols. These chip sets provide a convenient means of reliably communicating over the distances required here with a simple twisted wire pair. No further discussion of these issues are needed. The reader should simply recognize that the use of three separate data paths 25, 27, and 29 simplify the communication aspects of this invention.

It is also appropriate to briefly discuss the use of microprocessors to implement this invention. First of all, the reader should recognize that the functions of this invention can be provided by a digital device comprising a number of intercommunicating hardware digital elements. (By digital element is meant an element which provides digital, i.e. 0 and 1 logic levels, output signals in response to digital or analog input signals.) It has long been recognized that a computer such as a microprocessor can be programmed to function as and indeed structurally become, almost any digital electronic element. This occurs by virtue of the way in which a computer can execute the instructions forming the program controlling its operation.

The instructions controlling operation of a computer can be considered to have a number of groups, each intended to cause the computer to emulate the operation of one of the digital elements of the digital device. Execution of each group of the instructions causes the computer to temporarily become an actual hardware digital element of the device. The instructions are scripted so that their execution causes the computer to emulate the function of the corresponding hardware digital element. A computer of course is nothing more than electronic circuitry, and this circuitry physically becomes each individual digital element of the entire device for each brief period of time while executing instructions having that purpose.

It is axiomatic of course that every digital element in these types of digital devices provides one or more digital output signals when active. These signals have a pattern dictated by the digital input signals which the hardware digital element receives. During the time a computer executes instructions causing it to become a particular digital element, elements of the computer emit digital signals functionally similar to that which the corresponding hardware digital element would issue when receiving functionally similar input signals. In the computer emulation of a digital device, individual digital elements come into existence sequentially. Therefore, it is not possible to directly transmit the output signal of one digital element to the input terminals of other digital elements. Instead, the computer while emulating each digital element, stores in the computer's memory the information content of the data pattern or digital level of the signal(s) produced by executing the group of instructions dedicated to emulating that digital element. The information content in this data pattern or digital level is equivalent to the information content of the output signal which that emulated digital element would produce when receiving the specified input signals. The output pattern or level is thus available to the computer from its memory when it becomes another digital element of the digital device by executing another group of instructions. By retrieving that stored information content, the computer can recreate the original output signal from which the stored data or signal was formed for use as an input signal. This recreated signal is thus available to every digital element to be emulated in the future to allow that digital element to properly perform its functions.

Thus it is easy to see that one can replace with a computer executing appropriate software, nearly every group of hardware digital elements having interconnected signal paths between them which allow communication of data. In general, the functional equivalent of any digital device can be formed by such a computer when appropriate software is loaded into it. The cheapness and reliability of these small microprocessors makes it preferable to implement a digital device with them. It should be kept in mind though, that the implementation is for all practical purposes hardware based in the final analysis. No further attention need be paid to the precise implementation of the system of this invention since all which use the teachings of this patent are deemed equivalent.

In this explanation, the software can be explained most easily by a flow chart which specifies the various steps which the instruction groups perform in implementing this invention within a microprocessor. Regardless, each group of instructions configure the microprocessor in which the invention is practiced into a different functional element which performs the function specified for that group of instructions.

In the apparatus of FIG. 1, the various space comfort control functions are implemented within controller 10 and more particularly within the microprocessor type of computer forming a part of it. Module 20 is located within space 12 and houses the user interface and individual sensors which among other things sense temperature and humidity within space 12. At the present time we believe that temperature and humidity control is sufficient to provide a suitable interior environment for whatever purpose space 12 may have.

Humidity sensor 21 is shown as a single unit in FIG. 1, but in actuality comprises an analog sensor element which cooperates with the internal microprocessor of module 20 to provide a digital humidity signal in which is encoded a value $\phi_R$ indicative of the space 12 humidity. We prefer that $\phi_R$ be relative humidity, but it is also possible for the $\phi_R$ value to indicate dew point temperature or wet bulb temperature, as all three parameters provide some measure of the humidity level within space 12. We prefer relative humidity as the humidity parameter for space 12 because there are a number of sensors available which more or less directly measure this parameter with quite good accuracy.

An A/D converter which may be a part of the microprocessor within module 20 receives an analog humidity signal from the analog sensor element. The A/D converter provides a humidity signal encoding a digital value of the humidity parameter. This digital humidity signal encoding the $\phi_R$ value is sent to controller 10 on the path 25 forming a part of serial communication path 24.

Module 20 also includes a temperature sensor 23 which typically will include a conventional analog temperature sensor whose analogy temperature signal output is provided to an A/D converter element forming a part of the microprocessor which is internal to module 20. The structure and operation of temperature sensor 23 is similar to that of humidity sensor 21. Temperature sensor 23 provides a digital temperature signal on path 29 which encodes a value $T_R$ indicative of room or space temperature. Experience shows that merely measuring room air temperature is not as good an indication of comfort for humans in space 12 as a composite value which takes into account things like wall temperature and air movement within the space. We prefer to use a value $T_R$ which more accurately than air temperature indicates perceived human comfort of space 12. On occasion a space 12 may have more than one temperature sensor 23, in which case either the sensor closest to the least thermally resistive window or a simple average of all of the temperature values provided may be used.

A second temperature sensor 19 is mounted outdoors in a place which allows accurate measurement of outdoor temperature $T_O$. Sensor 19 should be located close enough to controller 10 to allow an analog signal from sensor 19 carried on path 31 to controller 20, to be read with reasonable accuracy. Controller 20 converts the analog outdoor temperature signal on path 31 to a digital value encoding the temperature value $T_O$.

Module 20 includes a user interface which accepts user inputs specifying individual parameters to control the operation of controller 10. In this respect, module 20 further comprises a user data supplier 22. User data supplier 22 is typically a manual input device such as a keypad on the module face although it could also be a rotatable knob for each of the temperature and humidity parameters. The user can manually operate the keys in the keypad to provide signals indicating user-preferred values of a temperature set point and a humidity set point, and a frost index value F which indicates the thermal resistivity (potential for frost) of a window 13. These three values are encoded in a composite user input (UI) signal carried on path 27. Again, note that these values are digitally encoded in the signal on path 27 provided to controller 10 as a part of the serial data path 24. Since the user input values can most easily be generated initially in a digital format it is only necessary to serialize them and send them to controller 10 on path 27. The frost index value is stored in a frost index register 11 forming a part of controller 10. In a typical embodiment where a microprocessor forms a part of controller 10, register 11 will simply comprise one or more memory locations within the microprocessor along with the control circuitry of the microprocessor which causes a frost index signal encoding the frost index value to be issued. A part of the composite user input signal comprises a frost index signal in which the frost index value is encoded.

Controller 10 receives the signals provided by module 20 and records the values encoded in them within a memory which is within controller 10. As mentioned earlier, controller 10 has a microprocessor for performing its various functions. A typical microprocessor will have a memory within it which can serve to record the values sent from module 20 to controller 10. When required for performing a particular function, the microprocessor in controller 10 can retrieve the needed value from this memory and encode this value in a signal which is identical in terms of information content to the signal provided by module 20 and which was recorded earlier. Since an internal microprocessor signal must be compatible with the internal microprocessor logic elements, it is almost certain that a signal encoding a value previously furnished by module 20 will have different voltage, frequency, duration, etc. characteristics than the signal provided by module 20.

In response to the signals provided by module 10 and also as a result of the logic built into the controller 10 microprocessor software, controller 10 provides a number of signals for controlling the environmental conditions within space 12. The two relevant to this invention are the heating active (HEAT ACTIVE) signal carried on path 55 and the humidification active (HUM ACTIVE) signal carried on path 57, and which were mentioned earlier in connection with a discussion of heating unit 40 and humidifying unit 44. There will also typically be a signal for causing fan 37 to operate, and there may well be other control signals such as damper control signals for controlling fresh air inlet 32, etc.

Figure 2:
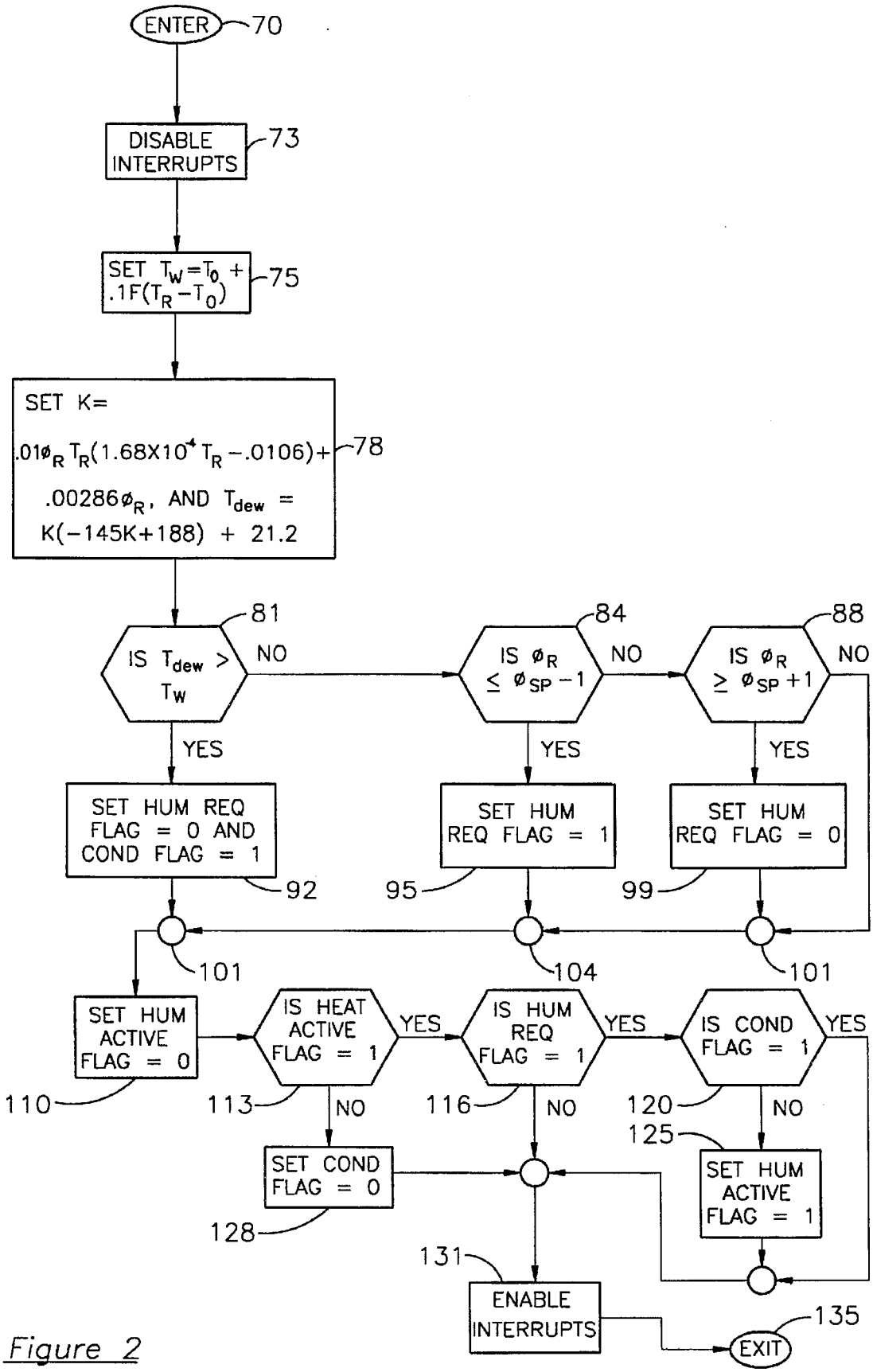
FIG. 2 is a flow chart of the steps performed by a microcontroller within the controller when implementing a preferred embodiment of the invention within a heating control apparatus.

The invention involves an improvement to controller 10, and its features are defined by the flow chart of FIG. 2. The reader should realize that controller 10 will comprise many other elements besides those defined by FIG. 2. Each of the parameters carried on serial communication path 24 is assumed to be recorded within the controller 10 and available for use by the internal microprocessor. In FIG. 2, there are four types of symbols, each indicating a different type of operation by the microprocessor of controller 10. While widely known, we still wish to mention that the instructions actually executed in the microprocessor of controller 10 are stored in a memory having addresses for each memory location in which instructions are recorded. The normal instruction execution operation of the microprocessor of controller 10 is to sequentially execute the instructions in memory locations having successive, positively incrementing addresses. This sequence is broken only by branch instructions and by interrupts. The effect of branch instructions is to cause the address of the next executed instruction to be set to a value different from the next sequential address and specified by the branch instruction. Branch instructions can be either conditional or unconditional. Interrupts are caused by events which cause the microprocessor's control logic to transfer execution to an instruction located at a specific address dependent on the type of interrupt occurring. Most microprocessors have an instruction which locks out interrupts to prevent this transfer of instruction execution. Another instruction will release interrupts permitting normal interrupt activity.

Each of the rectangular and hexagonal symbols in FIG. 2 represents one or more actual instructions which the microprocessor executes in performing the indicated function(s). The most common of the four symbols in FIG. 2 is the rectangular activity element such as at 73. An activity element specifies some type of computational, data transfer, or control operation. For example, activity element 73 specifies that all interrupts are disabled, meaning that none will be permitted until a later instruction (activity element 131) releases interrupts.

Hexagonal decision elements such as at 81 symbolize conditional branching in the instruction execution along either the YES or NO path. The path taken depends on the actual state of the condition whose testing is indicated within the decision element. Small circles indicate where two separate instruction execution paths rejoin. Ovals as at 70 indicate where the instruction sequence shown in the flow chart starts and is exited. In our commercial embodiment, the instructions which the FIG. 2 flow chart symbolizes are executed every 20 sec. A operation manager tracks the time between executions of this and other instruction sequences and transfers instruction execution to each at the proper time. One can expect that the execution speed of the microprocessor is so fast that every instruction sequence will be completed in sufficient time to permit the sequence next in time to be executed at the proper time.

Execution of the instructions symbolized in the flow chart of FIG. 2 and which configure the microprocessor in controller 10 as the invention starts with the instructions symbolized by the flow chart elements following the enter symbol 70. The first activity element 73 symbolizes instructions which disable interrupts.

The activity element 75 which symbolizes the instructions to be next executed performs a computation which calculates a theoretical interior window surface temperature $T_W=T_O+0.1F(T_R-T_O)$, where F is the frost index recorded in register 11 of FIG. 1 and which is a figure of merit indicative of the thermal resistivity of window 13 of FIG. 1 and $T_R$ and $T_O$ are the enclosed space and outside temperatures respectively. Each of these parameters are recorded in microprocessor memory locations and signals encoding these values are internally generated as a part of the microprocessor instruction execution. F is a value which is selected by the user and entered on the user interface module 20. For the formula of activity element 75, F should be in the range of 0 to 10, where 0 indicates the window material has no thermal insulating value, and 10 indicates that the window material is a perfect insulator. We find the following table provides typical values of F for various types of sashes:

| Sash type | F |
|---|---|
| Single pane glass | 2 |
| Double pane or thermopane | 5 |
| Triple pane | 8 |

These values are only approximations. We expect the user to alter the suggested value slightly until the windows of the enclosed space 12 never or rarely have condensed vapor on them. We find every enclosed space to have its own characteristics so far as window condensation is concerned.

As mentioned above, if there are more than one enclosed space temperature sensors, these values can be averaged or the temperature provided by the sensor closest to the window on which water is most likely to condense can be used.

Activity element 78 symbolizes instructions causing the microprocessor to perform further computations which derive an approximation for the dew point temperature $T_{dew}$ within space 12. An intermediate value K is first computed according to the equation shown. K is then used in the second equation of activity element 78 to actually compute $T_{dew}$. $\phi_R$ and $T_R$ are supplied by module 20 and are the relative humidity and temperature values within enclosed space 12. Other approximations for $T_{dew}$ are available in place of the equation shown. The equation shown in element 78 is one provided by the American Society of Heating, Refrigeration, and Air Conditioning Engineers (ASHRAE) and we presently believe it is the best available for the computation capacity of a small microprocessor.

The instructions symbolized by the remaining elements of FIG. 2 perform the logical operations for selecting when to provide the first value of the humidification active signal on path 57 to the humidifying unit 44. In connection with these logical operations there are a number of one bit values referred to as flags which are set to either 0 or 1 and which can be tested by decision element instructions. It is helpful to tabulate the meaning of each of these flags when equal to 0 as follows:

| Flag Name | Meaning When Equal to 0 |
|---|---|
| HUM REQ | Current value of $\phi_R$ relative to $\phi_{SP}$ indicates that humidification is not required |
| COND | The condition $T_{dew} > T_W$ has never existed during the current heating active cycle |
| HUM ACTIVE | The humidifying unit 44 is receiving the second value of the humidification active signal |
| HEAT ACTIVE | The heating unit 40 is receiving the second value of the heating active signal |

The present value of each of these flags is recorded in a selected memory location of the controller 10 microprocessor. Each time one of the flags is set to a specified value during the execution of one or more instructions, a data signal is generated within the microprocessor encoding this value. Each time one of the flags is accessed during the execution of instructions, a signal is generated within the microprocessor which encodes this value. Thus for example, when the condition (COND) flag is used during the execution of an instruction, a actual condition flag signal exists for a short period of time within the microprocessor of controller 10.

The instructions symbolized by decision element 81 test the relative magnitudes of $T_{dew}$ and $T_W$. If $T_{dew}>T_W$ is not true then the instructions symbolized by decision element 84 are executed next. If $T_{dew}>T_W$ is true, then the instructions of activity element 92 are executed next. The instructions which activity element 92 symbolize cause the HUM REQ flag to be set to 0 and the COND flag to be set to 1. After the instructions which element 92 symbolizes have been executed, execution proceeds with the instructions symbolized by activity element 110.

If the condition specified in decision element 81 does not exist, then the instructions symbolized by decision element 84 are executed. These instructions test whether $\phi_R$<or=$\phi_{SP}-1$ and if so, then the instructions which activity element 95 symbolizes are executed. If not, then the instructions of decision element 88 are next executed. The activity element 95 instructions set the HUM REQ flag to 1. If $\phi_R$>or=$\phi_{SP}+1$ is true, then the instructions which activity element 99 symbolizes are executed. The activity element 99 instructions set the HUM REQ flag to 0. One can see that if the inequalities of neither decision elements 84 nor 88 are satisfied, than the value of the HUM REQ flag is not changed and instruction execution continues with activity element 110. This creates a control band differential which prevents excessive cycling of the HUM REQ flag where $\phi_R$ is close to $\phi_{SP}$. After the instructions of either elements 95 or 99 are executed, the instructions of activity element 110 are executed next.

The instructions which element 110 symbolize cause the HUM ACTIVE flag to be set to 0. Then the instructions which decision element 113 symbolize test whether the HEAT ACTIVE flag is equal to 1. If not, the instructions of activity element 128 cause the value of the COND flag to be set to 0 and instruction execution proceeds with activity element 131. If the instructions which decision element 113 symbolize determine the HEAT ACTIVE flag is equal to 1, then instruction execution proceeds to the instruction of activity element 116. The instructions of element 116 tests whether the HUM REQ flag equals 1. If not, then instruction execution proceeds to activity element 131.

If the HUM REQ flag equals 1, then the instructions of decision element 120 are executed next. These instructions test whether the COND flag equals 1. If not, the instructions of activity element 125 which set the HUM ACTIVE flag to 1 are executed. If the COND flag was equal to 1, then instruction execution proceeds to activity element 131.

The instructions of element 131 releases the interrupt lockout which the instructions of activity element 73 caused, and the instructions of this flow chart have been completed. Instruction execution then returns through exit oval 135 to the operation manager.

The effect of the microprocessor executing this instruction sequence is to cause humidity to be added to the enclosed space air if it is too dry, if adding the humidity will not cause condensation on windows 13, and if the humidifying unit 44 will not be restarted in the current heating cycle after shutting down because of the possibility of window condensation. Note that humidifying unit 44 is allowed to restart during an existing heating cycle due to humidity which is too low.

The preceding has described the invention which we claim as follows:

1. A controller for apparatus for controlling both temperature and humidity within an enclosed space requiring addition of heat and humidity to maintain comfort, to preselected temperature and humidity set points respectively, said apparatus including a) a plenum; b) a return air duct connected to provide air from the space to the plenum; c) a heated air duct connected to allow air flow from the plenum to the space; d) a fan within the plenum for extracting air from the space through the return air duct and forcing the extracted air through the conditioned air duct into the space; e) a heating unit operating responsive to a first value of a heating active signal to heat air flowing through the plenum and not operating responsive to a second value of the heating active signal, and having a heat exchanger within the plenum; f) an air humidification unit operating responsive to a first value of a humidification active signal to humidify air flowing through the plenum and not operating responsive to a second value of the humidification active signal; g) an indoor temperature sensor within the space supplying an indoor temperature signal encoding a value indicative of the internal temperature of the space; h) a humidity sensor within the space providing a humidity signal encoding a value indicative of the relative humidity for the air within the space; i) an outdoor temperature sensor providing an outdoor temperature signal encoding a value indicative of the outdoor temperature; and j) a humidity set point generator providing a humidity set point signal encoding a humidity set point value, wherein the controller comprises:

I) a window temperature calculator receiving the outdoor temperature signal and the indoor temperature signal, and providing a window temperature signal encoding a window temperature value functionally depending on the temperatures encoded in the outdoor temperature signal and the indoor temperature signal;

II) a dew point temperature calculator receiving the indoor temperature signal and the humidity signal and providing a dew point temperature signal encoding a dew point temperature value for the space functionally depending on the temperature encoded in the indoor temperature signal and on the value encoded in the humidity signal; and III) a humidification unit controller receiving the window temperature signal from the window temperature calculator and the dew point temperature signal from the dew point temperature calculator, and responsive to the dew point temperature exceeding the window temperature, providing a humidification active signal having the first value to the air humidification unit.

2. The controller of claim 1, further comprising a frost index register in which may be recorded a frost index value indicative of the heat transfer characteristics of a window defining a part of the periphery of the enclosed space, said frost index register issuing a frost index signal encoding the frost index value, and wherein the window temperature calculator comprises means receiving the frost index signal, the outdoor temperature signal, and the indoor temperature signal, and providing a window temperature signal functionally depending on the values encoded in the outdoor temperature signal, the indoor temperature signal, and the frost index signal.

3. The controller of claim 2, wherein the frost index register records a frost index encoded in a frost index input signal, and wherein the controller further comprises manual input means for receiving a frost index value from a human user.

4. The controller of claim 1, further comprising a frost index register in which may be recorded a frost index value indicative of the heat transfer characteristics of a window defining a part of the periphery of the enclosed space, said frost index register issuing a frost index signal encoding the frost index value, and wherein the window temperature calculator comprises means receiving the frost index signal, the outdoor temperature signal, and the indoor temperature signal, and providing a window temperature signal functionally depending on the product of the frost index and the difference between the temperatures encoded in the indoor temperature signal and the outdoor temperature signal.

5. The apparatus of claim 4, wherein the dew point temperature calculator includes means for encoding in the dew point temperature signal, a dew point temperature value functionally depending on the product of the value encoded in the humidity signal and the square of the value encoded in the indoor temperature signal.

6. The apparatus of claim 1, wherein the dew point temperature calculator includes means for encoding in the dew point temperature signal, a dew point temperature value functionally depending on the product of the value encoded in the humidity signal and the square of the value encoded in the indoor temperature signal.

7. A controller for apparatus for controlling both temperature and humidity within an enclosed space requiring addition of heat and humidity to maintain comfort, to preselected temperature and humidity set points respectively, said apparatus including a) a plenum; b) a return air duct connected to provide air from the space to the plenum; c) a heated air duct connected to allow air flow from the plenum to the space; d) a fan within the plenum for extracting air from the space through the return air duct and forcing the extracted air through the conditioned air duct into the space; e) a heating unit operating responsive to a first value of a heating active signal to heat air flowing through the plenum and not operating responsive to a second value of the heating active signal, and having a heat exchanger within the plenum; f) an air humidification unit operating responsive to a first value of a humidification active signal to humidify air flowing through the plenum and not operating responsive to a second value of the humidification active signal; g) an indoor temperature sensor within the space supplying an indoor temperature signal encoding a value indicative of the internal temperature of the space; h) a humidity sensor within the space providing a humidity signal encoding a value indicative of the relative humidity for the air within the space; i) an outdoor temperature sensor providing an outdoor temperature signal encoding a value indicative of the outdoor temperature; j) a humidity set point generator providing a humidity set point signal encoding a humidity set point value; k) an inside temperature set point source providing an temperature set point signal encoding a set point temperature value; and l) a heating demand detector receiving the indoor temperature signal and the indoor temperature set point signal and providing a heating active signal having a first value responsive to a preselected relationship between the set point temperature value and the indoor temperature value, and a second value otherwise, wherein the controller comprises:

I) a window temperature calculator receiving the outdoor temperature signal and the indoor temperature signal, and providing a window temperature signal encoding a window temperature value functionally depending on the temperatures encoded in the outdoor temperature signal and the indoor temperature signal;

II) a dew point temperature calculator receiving the indoor temperature signal and the humidity signal and providing a dew point temperature signal encoding a dew point temperature value for the space functionally depending on the temperature encoded in the indoor temperature signal and on the value encoded in the humidity signal;

III) first decision means receiving the heating active signal for responsive to the first value thereof providing a condition signal having a first value responsive the heating active signal changing from its first to its second value;

IV) second decision means receiving the window temperature signal and the dew point temperature signal for responsive to the dew point temperature value exceeding the window temperature value providing a condition signal having a second value and leaving the present value unchanged otherwise; and V) third decision means receiving the condition signal for providing the humidification active signal with its first value responsive to the first value of the condition flag and the humidification active signal with its second value responsive to the second value of the condition flag.

8. The apparatus of claim 7, wherein the third decision means further comprises fourth decision means receiving the heating active signal, for providing the humidification active signal responsive to the first value of the heating active signal.

* * * * *